US006269519B1

(12) United States Patent
Harvey et al.

(10) Patent No.: US 6,269,519 B1
(45) Date of Patent: Aug. 7, 2001

(54) DUCT CLEANING DEVICE

(75) Inventors: Dave Harvey; Frank Goodman, both of Calgary (CA)

(73) Assignee: Esteam Manufacturing Ltd., Alberta (CA)

( * ) Notice: Subject to any disclaimer, the term of this patent is extended or adjusted under 35 U.S.C. 154(b) by 0 days.

(21) Appl. No.: 09/419,078

(22) Filed: Oct. 15, 1999

(51) Int. Cl.[7] ..... A47L 9/04
(52) U.S. Cl. ..... 15/387; 15/383; 15/395
(58) Field of Search ..... 15/387, 395, 383

(56) References Cited

U.S. PATENT DOCUMENTS

| | | | | |
|---|---|---|---|---|
| 754,955 | * | 3/1904 | Lemke | 15/387 X |
| 1,580,294 | | 4/1926 | Gawley . | |
| 2,078,634 | * | 4/1937 | Karlstrom | 15/387 X |
| 3,006,022 | * | 10/1961 | Mamontov | 15/387 X |
| 4,792,363 | | 12/1988 | Franklin, Jr. et al. . | |
| 4,800,616 | * | 1/1989 | Wade | 15/387 X |
| 5,107,568 | | 4/1992 | Wade . | |
| 5,109,567 | | 5/1992 | Harrison . | |
| 5,428,862 | * | 7/1995 | Sailer | 15/387 X |
| 5,528,789 | * | 6/1996 | Rostamo | 15/395 X |
| 5,584,093 | | 12/1996 | Melendres . | |
| 5,608,941 | | 3/1997 | Kleinfeld . | |
| 5,655,256 | | 8/1997 | Hendrix et al. . | |
| 5,735,016 | * | 4/1998 | Allen et al. | 15/395 X |
| 5,802,667 | | 9/1998 | Williams . | |

FOREIGN PATENT DOCUMENTS

| | | | | |
|---|---|---|---|---|
| 2221385 | | 11/1996 | (CA) . | |
| 2180681 | | 1/1998 | (CA) . | |
| 2064410 | * | 7/1971 | (DE) | 15/387 |
| 197 51 322 C2 | | 5/1998 | (DE) . | |
| 38834 | * | 6/1928 | (DK) | 15/387 |

* cited by examiner

*Primary Examiner*—Chris K. Moore
(74) *Attorney, Agent, or Firm*—Morgan, Lewis & Bockius LLP

(57) ABSTRACT

A duct cleaning device including a flexible conduit having a first end and a second end with inlets at first end and outlets at second end to allow air to circulate within the conduit. A whipper located at first end is rotated by a drive shaft, housed within the conduit, and powered by an air-activated drive system located near to the whipper at first end of the conduit. A stationary circular brush is also located around the conduit near its first end. In operation, the air-activated drive system is activated by air passing though the conduit preferably when a vacuum is applied. The vacuum is created a pressure reducing air pump To which the second end of the conduit is attached. The device may be mounted with a dolly, and displaced within a duct using rods attached to the dolly. The loosened debris generated by the action of The whipper and brush on the internal surfaces of the duct are aspirated through the inlets and into the conduit by the vacuum.

22 Claims, 3 Drawing Sheets

DUCT CLEANING DEVICE

The present invention relates to a device for cleaning ducts. More specifically, this invention pertains to a duct cleaning device with a vacuum activated rotating whipper.

BACKGROUND OF TH INVENTION

U.S. Pat. No. 5,655,256 is directed to a stationary rectangular brush for cleaning ducts that is attached to the terminal end of a vacuum hose. This brush loosens debris as die vacuum hose is moved within the duct. U.S. Pat. No. 5,802,667 discloses a duct cleaning device having a rotatable brush mounted in a helical configuration around the outer surface of a vacuum hose. The helical configuration of the brush causes rotation of the brush as it is advanced within a duct, however, there is no independent rotation of the brush if the vacuum hose is not moving within the duct, U.S. Pat. No. 5,608,941 and U.S. Pat. No. 4,792,363 describe a rotating brush positioned at the front of a vacuum hose for cleaning a duct interior. The brush rotates about a drive shaft that extends through the vacuum hose to a power source. An alternate external drive means is disclosed in U.S. Pat. No. 5,584,093 where the brush is rotated by incoming air pressure supplied by an air supply source through a hose mounted on the vacuum hose U.S. Pat. No. 5,109,567 teaches a duct cleaning device having rotating tubes disposed at the leading end of a vacuum hose. The tubes are connected to a compressed air source and the pressure caused by forcing compressed air through the tubes causes rotation of the tubes within the duct. A similar approach and device is taught in CA U.S. Pat. No. 2,221,385.

U.S. Pat. No. 5,107,568 relates to a duct cleaning device having a single brush extending from the leading end of a vacuum hose. The brush is attached to a flexible drive shaft that passes through the vacuum hose to a turbine located within the vacuum hose, but outside of the duct being cleaned. As air passes through the vacuum hose the turbine and drive shaft rotate.

These prior art devices disclose the use of a rotatable brush set in motion either manually or by a drive shaft attached to a drive means. The debris loosened by the action of the brush against the internal surfaces of ducts are then aspirated by the vacuum hose. These arrangements necessitate long drive shafts or other external sources to power the brush which rub against the interior of the vacuum hose losing poser; and reduce the effective vacuum hose cross sectional area.

Accordingly there is a need for an improved device for cleaning the internal surfaces of ducts.

It is an object of the invention to overcome disadvantages of the prior art.

The above object is met by the combinations of features of the main claims, the sub-claims disclose further advantageous embodiments of the invention.

SUMMARY OF THE INVENTION

The present invention relates to a device for cleaning ducts. More specifically, this invention pertains to a duct cleaning device with a vacuum activate rotating whipper.

The present invention pertains to a cleaning head comprising a tubular housing having a bore, a first end and a second end, where pr second end is attached to flexible hose. The housing comprises one or more openings at or near the first end, and a shaft having a proximal and a distal end. The shaft axially located within the bore of the housing, and rotatably attached to the housing. The proximal end of the shaft extending out from the first end of tile housing. The cleaning head farther comprises a whipper coupled to the proximal end of the shaft, and a drive means coupled to the shaft and located within the housing. The cleaning head also comprises at least one radially extending brush attached to the housing and located behind the one or more openings of the housing. Preferably, the drive means comprises a screw auger.

The present invention also includes the cleaning head as described above further comprising a dolly. The dolly preferably comprising at least two wheel assemblies.

The present invention also embraces a duct cleaning device, comprising, a flexible hose operational connected with the cleaning head as described above.

The duct cleaning device of the present invention loosens and removes debris from the internal surface of air ducts. The duct cleaning device comprising a flexible conduit having an interior, first and second ends, said first end capable of being inserted into a duct for cleaning purposes. Inlet means at the first end and outlet means at the second end ate provided to allow air to circulate through the conduit. A drive shaft means within the conduit at the first end has a proximal end, coupled to a debris-loosening rotary circular whipper located at the first end of the conduit, and a second end coupled to an air-activated drive means located behind the rotary whipper, within the conduit. The drive shaft means is rotatable upon flow of air through the air-activated drive means. A sweeper element extends circumferentially around a portion of the conduit, and sweep debris from an internal surface of a duct.

In another aspect of the present invention, the second end of the conduit is attached to an air pump means, located outside the duct, for reducing the pressure within the conduit causing air to flow through the conduit for effecting the rotation of the air-activated drive means, and for removing matter loosened within the duct by the rotary whipper and sweeper element.

This summary of the invention does not necessarily describe all necessary features of the invention but that the invention may also reside in a sub-combination of The described features.

Advantageously, the air-activated drive means of the present invention is positioned within the leading portion of the vacuum hose, immediately adjacent with the rotatory whipper assembly. The air-activated drive means is powered by the air flow through the vacuum hose when a vacuum is applied through the vacuum hose. With such an arrangement, there is no need for lengthy drive shafts, which rub against the interior of the vacuum hose losing poser and reduce power and reducing the effective vacuum hose cross sectional area, or other external sources to power the rotating whipper, for example high pressure hoses.

BRIEF DESCRIPTION OF THE DRAWINGS

These and other features of the invention will become more apparent from the following description in which reference is made to the appended drawings wherein:

FIG. 1(A) shows a cleaning head with a screw auger drive means.

DESCRIPTION OF PREFERRED EMBODIMENT

The present invention relates to a device for cleaning ducts. More specifically, this invention pertains to a duct cleaning device with a vacuum activated rotating whipper.

The following description is of a preferred embodiment by way of example only and without limitation to the combination of features necessary for carrying the invention into effect.

Figure 1A:
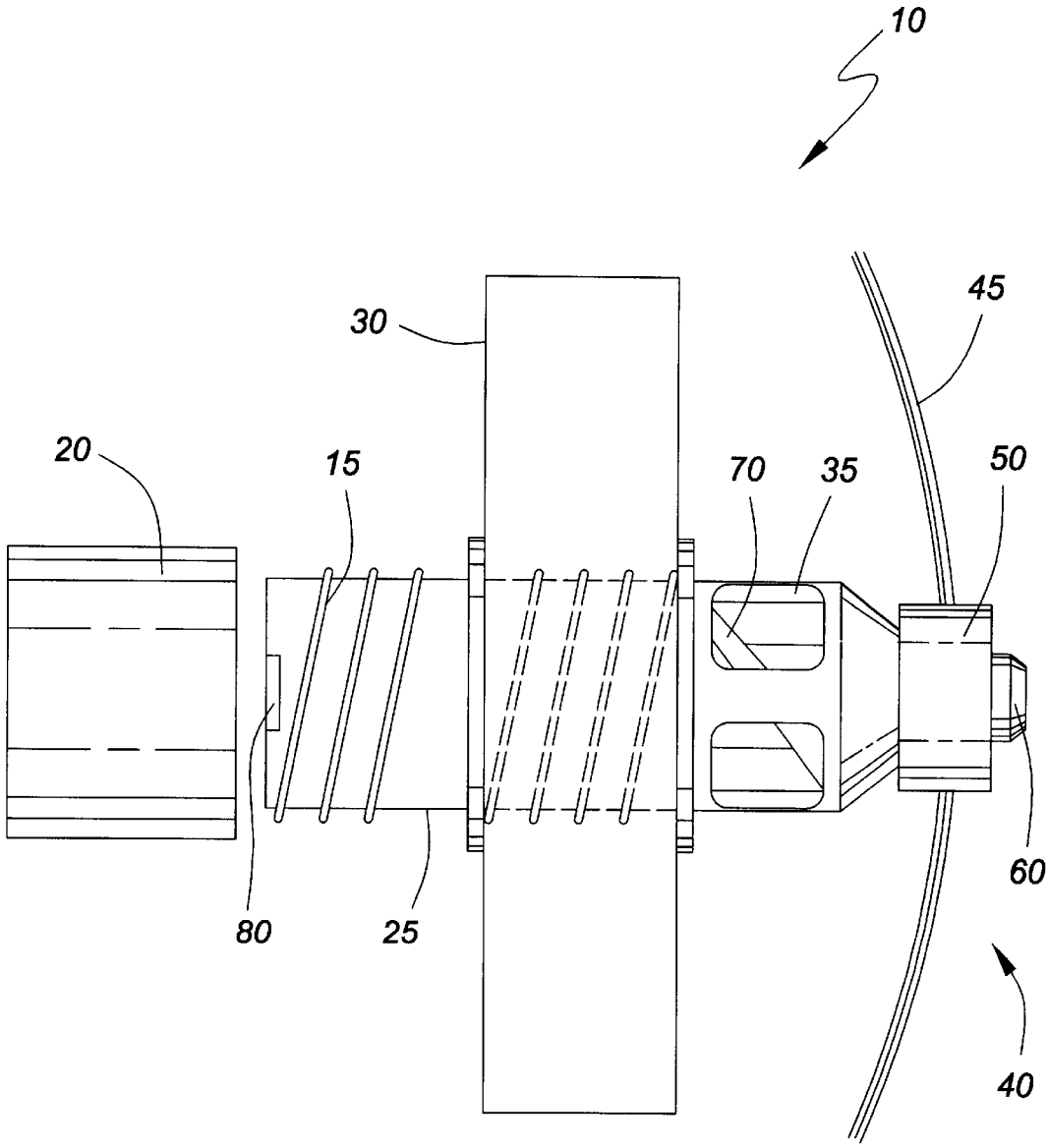
FIGS. 1(A) and (B) show a side view of an aspect of an embodiment of the present invention comprising a cleaning head with bristle brush and rotating whipper.
Figure 1B:
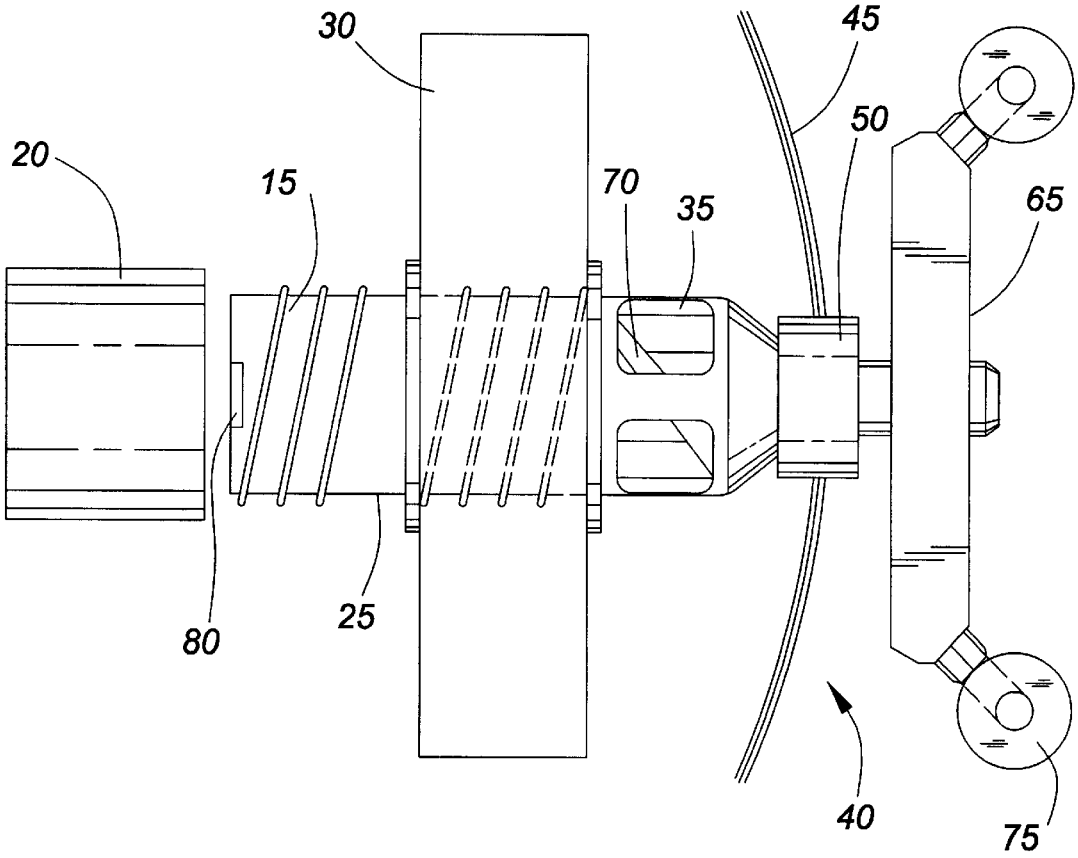
FIG. 1(B) shows a cleaning head with a fan drive means and a dolly.
Figure 2:
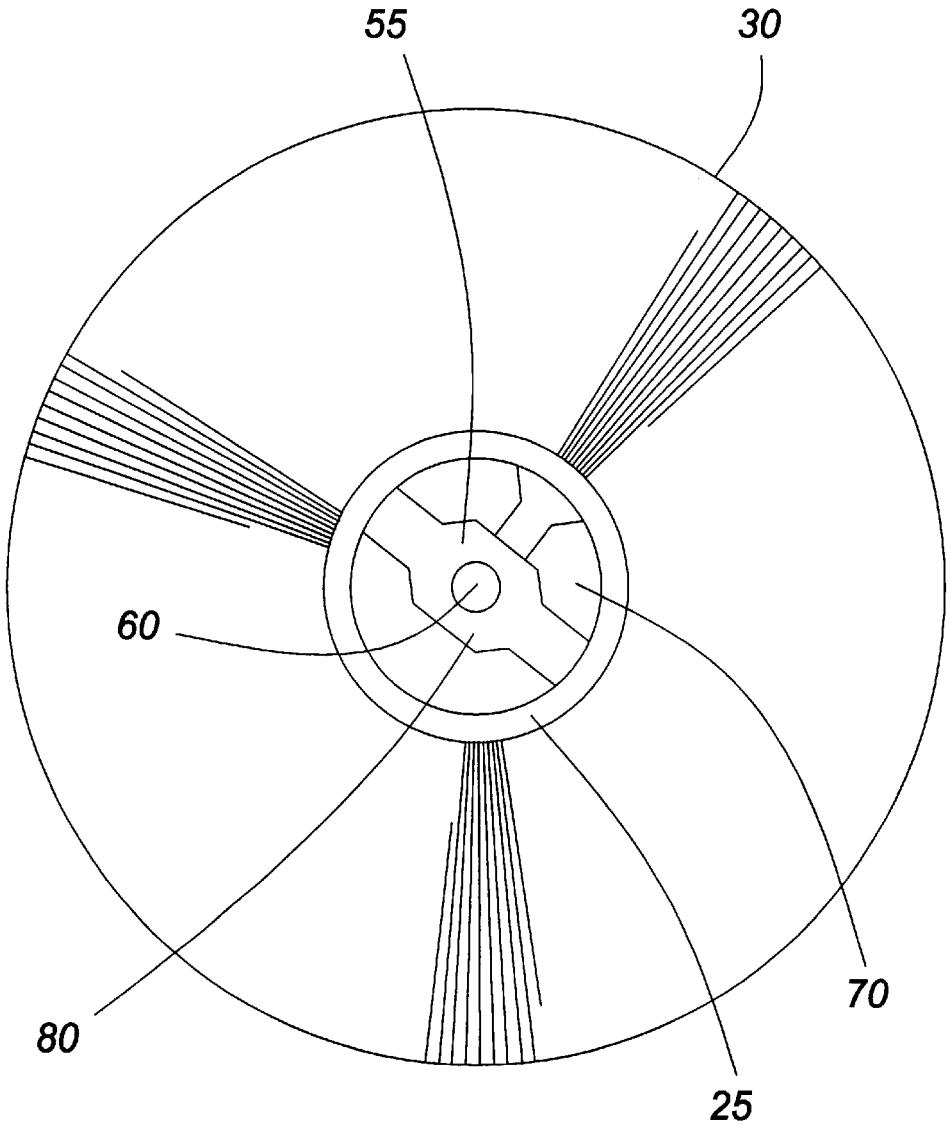
FIG. 2 shows an end view, from the back of an aspect of an embodiment of the present invention of a cleaning head.

With reference to FIGS. 1(A) and (B) and 2, the duct cleanina device comprises a cleaning head (10) which may be releaseably attached to, or integrated with, a flexible conduit or vacuum hose (20). The cleaning head comprises a tubular housing (25) to which one or more radial brushes 30 are attached The tubular housing may be of any appropriate length required to traverse a duct an4 house the drive means and whipper as described below. At, or adjacent the front end of the housing is positioned one or more openings 35, that freely permit the passage of air from outside the cleaning head through opening (35) and bore of the cleaning head to The vacuum hose 20. The openings may be positioned along the side of the housing as indicated in FIG. 1(A), at the front end of the housing, or a combination thereof.

Whipper (40) is comprised of a plurality of bristles (45), each bristle or cluster of bristles are attached to a coupler (50). Coupler 50 is affixed to shaft 60 via any suitable means, for example but not limited to, a key or screw. Shaft 60 is rotatably mounted to the front end of housing 25 via any suitable means for example, but not limited to, a bearing. Shaft 60 extends though the bore of cleaning head 10, and is rotatabty attached to a stabilizer bar (80) via a second bearing (55) or any other suitable means as known in the art, for example bat not limited to a lubricated or polymeric sleeve. Stabilizer bar 80 is positioned within the housing, for example, at the rear of the cleaning head.

If opening 35 is positioned at the front end of housing 25, a second stabilizer bar may be used to rotatably mount shaft 60 at the front end of the housing. If openings (35) are positioned along the sides of the housing, then the front end of the housing may be sealed and a bearing or other suitable means that permits rotational attachment of shaft 60 to the front of the housing positioned centrally therein.

An air activated drive means, 70, is attached to shaft 60, so that when the cleaning head is attached to vacuum hose 20, and a vacuum is applied though the vacuum hose, air enters openings 35 and passes though the bore and by drive means 70 thereby imparting rotation to shaft 60 through drive means 70. Any suitable drive means that is activated by air passing though the bore may be used to impart rotation to shaft 60 and attached whipper 40. For example, which is not to be considered limiting in any manner, drive means (70) may comprise one or more fans, each fan comprising a plurality of blades that extend radially from a sleeve that is attached to the shaft. The blades may be of any length, for example up to about the circumference of housing 25. However, it is to be understood that the length of each blade is sized and spaced in such a manner so that particulate matter may readily pass through the bore and not clog the drive means, while at the same time, the blades of a sufficient length to ensure chat the drive means is activated when a vacuum is applied through hose 20.

Drive means 70 may also comprise a screw auger, attached to a sleeve that is attached to the shaft, or the screw auger may be directly attached to shaft 60. The screw auger extends from about the front end of the shaft, adjacent to opening 35 (see FIG. 1(A)), and along the shaft towards stabilizer bar (80). The screw auger may be of any suitable length and extend part, or all of the length of shaft 60. Preferably, the screw auger completes at least one revolution around shaft 60. The screw auger may be continuous of discontinuous along the length of shaft 60. The screw auger may also comprise one or more blades that extend perpendicularly from the shaft and which are of a height suitable to impart rotation to the drive means when a vacuum is applied through the vacuum hose. Preferably, drive means 70 is a screw auger.

By using a drive means as described above, located at the front of the vacuum hose and activated by the air flow arising from a vacuum within the vacuum hose, no lengthy drive shafts or pressure hoses are required with the cleaning head of the present invention. Furthermore, no movement of the vacuum hose within the duct is required to activate the whipper.

Preferably housing 25 is made from a rigid material such as a thermoplastic plastic or metal, and provides rigid support to withstand a vacuum applied through hose 20, rotation of shaft 60 and whipper 40 attached thereto, as well as the resistance felt by brush 30 as the cleaning head is passed through a duct. Cleaning head 10 may be permanently affixed to vacuum hose 20 by any suitable means including rivets, welding and the Like, or the cleaning head may be integrated with, and manufactured as one piece with, the vacuum hose. It is also conceived that cleaning head 10 may be releaseable attached to the vacuum hose and removed as required to substitute heads with varying diameter brushes (30) and whippers (40). Means for releaseable attachment include either internal or external screw threads (15) on housing 25, That mate with corresponding screw threads either on the external or internal surface of vacuum hose 20, respectively, or the housing may slide within or over the vacuum hose and be releaseably attached using screws, blots, C-clip, pins or other releaseable attachment means. Preferably, cleaning head 10 fits tightly with vacuum hose 20 to minimize loss of vacuum at this junction.

One or more circular bristle brushes 30 may be attached to housing 25. The bristle brushes are made from any suitable bristle as known in the art and are typically attached to a sleeve that may be releaseably mounted over housing 25. Such releaseable mounting may include screw threads on the inside of the sleeve that mate with screw threads positioned on the outer surface of housing 25. The brush-sleeve assembly may also be attached using screws, bolts, C-clips and the like. Preferably, the brush is removable from housing 25, however, brush 30 may also be permanently attached to the housing. The bristles of brush 30 extend radially from the sleeve or housing and are of a length to fit within a duct of similar diameter thereby removing debris from the inside of the duct wall, while also positioning cleaning head (10) centrally within the duct. The bristles are of a sufficient rigidity to permit cleaning of the inside of the duct, while not limiting movement of the cleaning head within the duct. Brush 30 typically comprises a plurality of rows of bristles, and if desired, one or more brushes may be positioned along housing 25. These brushes, or bristles within one brush may be of the same or different stiffness. However, it is to be understood that the cleaning head of the present invention may also comprise other means for centering the cleaning head within a duct, for example but not limited to wheel assemblies (described below), or extending tubular members (see U.S. Pat. No. 5,109,567, which is incorporated here in by reference). If there is no circular bristle brush positioned on the cleaning head, then dirt and debris within he duct are dislodged by the whipper.

Whipper 40 comprises bristles (45) that radially extend from coupler 50 and are of a length and stiffness that ensures that when the inside surface of a duct is struck by the rotating bristles, debris is loosened and dislodged from the duct. The bristles of whipper 40 may be grouped in clusters of bristles (45), each cluster positioned around the circumference of coupler 50. Whipper 40 comprises at least one such cluster of bristles. A bristle or cluster of bristles may be releaseably attached to coupler 50, typically passing though openings within coupler 50 and attached thereto via a screw, for example, but not limited to a set screw, thereby permitting replacement of the bristles (45) as required. Whipper 40, comprising bristles (45) and coupler 50, may .also be replaced as a unit as needed to ensure a whipper of sufficient diameter for the duct to be cleaned, or to replace the bristle clusters. One or more rows of bristles may be placed along coupler 50. The bristles may be made from, but are not limited to, a stiff polymeric material, for example a plastic, or flexible spring wire, or a combination thereof.

The cleaning head of the present invention, when attached to a flexible conduit, or vacuum hose, is introduced within a duct to be cleaned. The vacuum hose is operationally connected to a motor means capable of producing a vacuum within the vacuum hose. The motor means may be that as found in any standard vacuum device including hand pushed portable vacuum cleaners, or truck mounted vacuum cleaners. The vacuum applied by the motor means draws air from the duct being cleaned into the cleaning head thereby activating the drive means as described above.

To assist in the passage of the cleaning head-vacuum hose assembly through the duct, a dolly (65) may be attached to the cleaning head, or vacuum hose immediately behind the cleaning head so help position the cleaning head centrally within the duct. The dolly may comprise two or more wheel assemblies (75) that ride along the interior of the duct These wheel assemblies may be attached to radially extendable arms which are affixed at one end to the cleaning head or vacuum hose (see U.S. Pat. No. 5,584,093, which is incorporated herein by reference). If two wheel assemblies are used. These assemblies are positioned on opposite sides of the cleaning head, or vacuum hose, to ensure a central position of the cleaning head within the duct. However, more than two assemblies may be used, preferably placed equidistantly around the circumference of the cleaning head or vacuum hose. Rods may be used to push the dolly and assist in passage of the cleaning head through the duct. These rods may be pivotally attached to, or removably positioned against a registration means to, guide the cleaning head-vacuum hose assembly with a duct.

The above description is not intended to limit the claimed invention in any manner, furthermore, the discussed combination of features might not be absolutely necessary for the inventive solution.

All citations are herein incorporated by reference.

The present invention has been described with regard to preferred embodiments, however, it will be obvious to persons skilled in the art that a number of variations and modifications can be made without departing from the scope of the invention as described herein.

The embodiments of the invention in which an exclusive property of privilege is claimed are defined as follows:

1. A cleaning head comprising:

a tubular housing having a bore, a first end and a second end, said second end adapted to attach to a conduit, said housing further comprising at least one or more opening at or adjacent said first end;

a shaft axially located within said bore and rotatably attached to said housing, said shaft passing through, and extending outward from, said first end of said housing;

a whipper coupled to said shaft, said whipper located outside of said first end of said housing;

a vacuum activated drive means coupled to said shaft, said drive means located within said housing; and a means for centering said cleaning head within a duct.

2. The cleaning head of claim 1 wherein said at least one opening are positioned along the side of said housing.

3. The cleaning head of claim 2, wherein said first end of said housing is sealed and comprises a radially centered means for rotatably attaching said shaft.

4. The cleaning head of claim 3, further comprising a stabilizer bar positioned adjacent said second end of said housing, said shaft being rotatably mounted on said stabilizer bar.

5. The cleaning head of claim 4 wherein said drive means comprises a screw auger.

6. The cleaning head of claim 5 wherein said whipper comprises at least one bristle cluster.

7. The cleaning head of claim 6, wherein said whipper is releaseably attached to said shaft.

8. The cleaning head of claim 6 attached to a dolly.

9. The cleaning head of claim 8 wherein said dolly comprises at least two wheel assemblies.

10. A duct cleaning device, comprising, the cleaning head of claim 6 attached to said conduit, wherein said conduit is a flexible hose.

11. The duct cleaning device of claim 10 wherein said cleaning head is releaseably attached to said flexible hose.

12. The duct cleaning device of claim 10 wherein said cleaning head is integral with said flexible hose.

13. The duct cleaning device of claim 6 attached to a dolly.

14. The duct cleaning device of claim 13, wherein said dolly comprises at least two wheel assemblies.

15. The cleaning head of claim 4 wherein said drive means comprises at least one fan.

16. The cleaning head of claim 1, wherein said centering means comprises at least one radially extending brush attached to said housing behind said at least one opening.

17. A duct cleaning device, comprising, the cleaning head of claim 1 attached to said conduit, wherein said conduit is a flexible hose.

18. A cleaning head comprising:

a tubular housing having a bore, a first end and a second end, said second end adapted to attach to a vacuum hose, said first end of said housing is sealed and comprises a first means for radially centering and rotatably attaching a shaft within said bore, said housing comprises at least one opening positioned along the side of said housing adjacent said first end, said shaft passing through, and extending outward from, said first end of said housing;

a stabilizer bar positioned adjacent said second end of housing and comprising a second means for radially centering and rotatably attaching said shaft;

said shaft axially located within said bore, and rotatably attached to said first means and said second means;

a whipper coupled to said shaft, said whipper located outside of said first end of said housing;

a vacuum activated drive means coupled to said shaft, said drive means being a screw auger, said drive means located within said housing; and at least one radially extending brush attached to said housing behind said one or more openings.

19. The cleaning head of claim 18 attached to a dolly.

20. The cleaning head of claim 19 wherein said dolly comprises at least two wheel assemblies.

21. A duct cleaning device, comprising, a vacuum hose attached to the cleaning head of claim 18.

22. The cleaning head of claim 1 further comprising a stabilizer bar positioned adjacent said second end of housing, a means for radially centering and rotatably attaching said shaft on said stabilizer bar.

* * * * *